US005490788A

United States Patent [19]

Mazzochette

[11] Patent Number: 5,490,788

[45] Date of Patent: Feb. 13, 1996

[54] SURFACE MOUNT TERMINAL FOR ELECTRICAL COMPONENT

[75] Inventor: Joseph B. Mazzochette, Cherry Hill, N.J.

[73] Assignee: EMC Technology, Inc., Cherry Hill, N.J.

[21] Appl. No.: 332,949

[22] Filed: Nov. 1, 1994

[51] Int. Cl.[6] ..... H01R 9/09

[52] U.S. Cl. ..... 439/83; 439/876

[58] Field of Search ..... 439/83, 876

[56] References Cited

U.S. PATENT DOCUMENTS

| | | | |
|---|---|---|---|
| 3,864,014 | 2/1975 | Lynch | 439/389 |
| 3,993,383 | 11/1976 | Marino | 439/848 |
| 4,598,972 | 7/1986 | Mullen, III et al. | 439/876 |
| 4,728,305 | 3/1988 | Seidler | 439/876 |
| 4,738,627 | 4/1988 | Seidler | 439/876 |
| 4,780,098 | 10/1988 | Seidler | 439/876 |
| 4,900,279 | 2/1990 | Dennis | 439/876 |
| 4,978,307 | 12/1990 | Billman et al. | 439/83 |
| 5,015,206 | 5/1991 | Dennis | 439/876 |

*Primary Examiner*—Gary F. Paumen
*Attorney, Agent, or Firm*—Donald S. Cohen

[57] ABSTRACT

An electrical terminal for an electrical component to surface mount the component on a printed circuit board with the component extending upright from the printed circuit board. The electrical terminal includes a metal strip having a pair of spaced tabs extending in the same direction from the metal strip to form an U-shaped clip within which the electrical component fits. A separate foot extends from each tab with the feet being aligned in the same plane and extending in opposite directions from the tabs. The feet are adapted to seat on the surface of a printed circuit board to support the electrical component in the upright position on the board. A plurality of the terminals are mounted in spaced relation along an edge of the electrical component and can be soldered to terminal pads on the electrical component to electrically and mechanically connect the terminals to the electrical component.

32 Claims, 2 Drawing Sheets

SURFACE MOUNT TERMINAL FOR ELECTRICAL COMPONENT

FIELD OF THE INVENTION

The present invention relates to an electrical terminal for surface mounting an electrical component on a printed circuit board, and, more particularly, to electrical terminal for an electrical component arranged in a strip configuration which may be secured to the edge of an electrical component to allow the electrical component to be surface mounted in an upright position.

BACKGROUND OF THE INVENTION

Electrical components of various types have electrically conducting terminals which allow the component to be electrically connected to other electrical components and to printed circuit boards. Often such terminals are also used to mechanically support the electrical component on another electrical components, such as a printed circuit board. Some of such terminals have U-shaped clips formed at one end which fit over an edge of the electrical component and make electrical contact with an active portion of the component. The other end of the terminals then fit into holes or the like in a printed circuit board to mount the component on the board and provide electrical connection to the interconnecting circuit on the board. Such electrical terminals are shown in U.S. Pat. No. 3,993,383, to V. Marino issued Nov. 23, 1976, entitled "Printed Circuit Electrical Connectors", and U.S. Pat. No 3,864,014, to J. E. Lynch, issued Feb. 4, 1975, entitled "Coined Post For Solder Strip". These patents also show that it is common to form the terminals in spaced parallel relation along a connecting strip. The strip often supports the terminals while they are being mounted on the electrical component. The strip is then cut away to leave the individual terminals mounted on the electrical component.

If the terminals are mounted along an edge of an electrical component, the free ends of the terminals are often bent at substantially right angles to the remaining portion of the terminal. This allows the free ends of the terminals to be secured to a printed circuit board with the electrical component extending substantially parallel to the board. To allow the electrical component to take up less area of the board, it is often desirable to have the component mounted upright on the board. This could be achieved by having the terminals extending outwardly from the edge of the component substantially parallel to the component and inserting the terminals in holes in the board. The component would then extend upright from the board. However, the terminals are flexible and the components would be subject to being easily moved. This would cause the terminals to be bent and could cause breakage of the terminals. Therefore, it would be desirable to have a terminal for an electrical component which would allow the component to be surface mounted on the board in an upright position and in a sturdy manner which would not cause the terminals to be bent and possibly broken.

SUMMARY OF THE INVENTION

The present invention is directed to an electrical component comprising a body having an edge and at least one electrical terminal secured to said body at said edge. The terminal comprises a metal strip having a plurality of spaced tabs extending in the same direction from the strip and forming a U-shaped clip therebetween with the edge of the body fitting within the U-shaped clip between the tabs. A pair of feet extend in substantially the same plane in opposite directions from the tabs and are adapted to support the electrical component on the surface of a printed circuit board.

The present invention is also directed to an electrical terminal which comprises a metal strip having a plurality of spaced tabs extending in the same direction from the strip and forming a U-shaped clip therebetween which is adapted to receive an electrical component therebetween. A pair of feet extend in substantially the same plane in opposite directions from the tabs to support the terminal on the surface of a printed circuit board.

The present invention is further directed to a carrier strip comprising a flat metal carrier strip having a plurality of metal terminal strips spaced along and extending in the same direction from the carrier strip. A plurality of spaced tabs extend in the same direction from each of the terminal strips and form a U-shaped clip therebetween. A foot portion extends from one of the tabs on each terminal strip to the free end of the terminal strip, and a notch extends across each terminal strip spaced from another tab to form another foot between the notch and the other tab.

DETAILED DESCRIPTION

Figure 1:
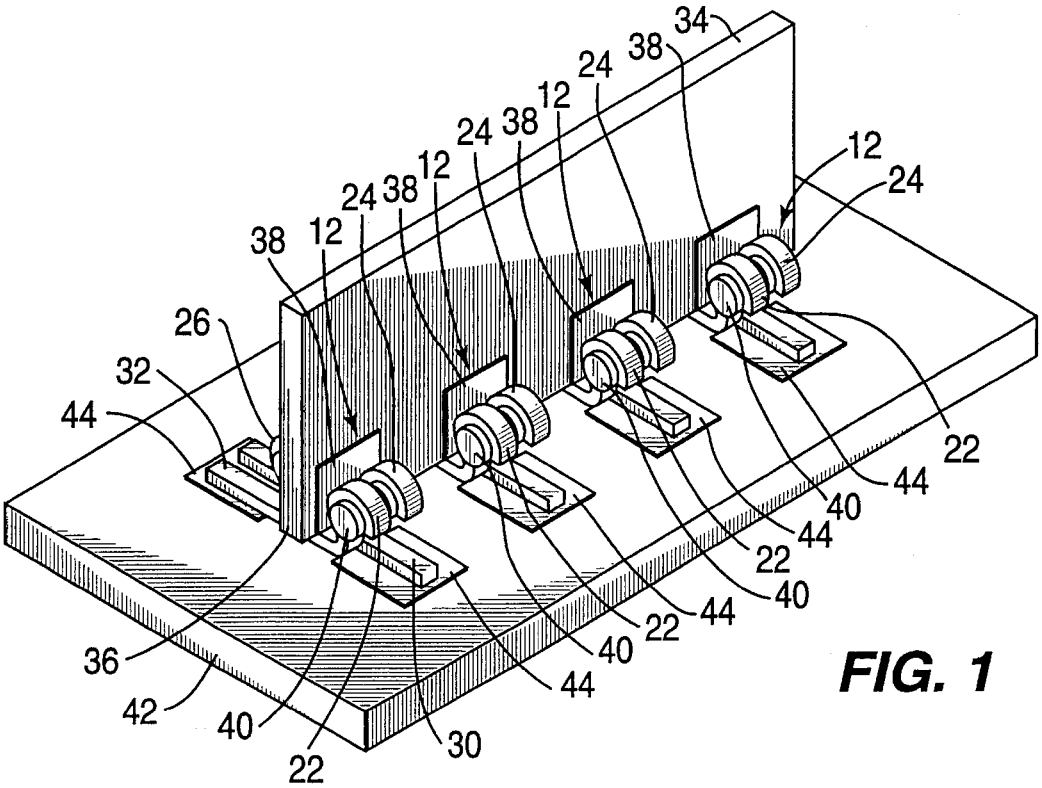
FIG. 1 is perspective view of an electrical component having thereon one form of the electrical terminal of the present invention and surface mounted on a printed circuit board.

Referring initially to FIG. 1, there is shown an electrical component 34 which is substantially rectangular and has a plurality of one form of the electrical terminals 12 of the present invention mounted thereon and secured to one edge 36 thereof. Each of the electrical terminals 12 is a flat metal strip 20 having a pair of tabs 22 and 24 projecting in the same direction from a surface thereof. The tabs 22 and 24 are in spaced side-by-side relation and are along opposite side edges of the strip 20. The free ends of the tabs 22 and 24 are bent in the form of an open circle which faces substantially toward a free end of the strip 20. A third terminal tab 26 projects from the strip 20 in the same direction as the tabs 22 and 24. The tab 26 is spaced from the tabs 22 and 24 and is positioned between the tabs 22 and 24. The tab 26 has its free end bent in the form of an open circle which faces away from the tabs 22 and 24. Thus the tab 26 forms with the tabs 22 and 24 a substantially U-shaped clip within which the edge 36 of the electrical component 34 fits. A first mounting foot 30 extends from the tabs 22 and 24, and a second mounting foot 32 extends from the tab 26 in a direction opposite to that of the first foot 30. The mounting feet 30 and 32 are in substantially the same plane.

The electrical component 34 has a thickness slightly greater than the distance between the tab 26 and the tabs 22 and 24 so that the tabs 22, 24 and 26 are flexed slightly so as to tightly grip the electrical component 34. The electrical component 34 has spaced metal terminal pads 38 on both of the surfaces thereof along the edge 36. The terminal pads 38 on one side of the electrical component 34 are engaged by the tabs 22 and 24, and the terminal pads 38 on the other side of the electrical component 34 are engaged by the tabs 26 so as to provide electrical connection between the terminals 12 and the active portion of the electrical component 34. A short rod 40 of a solder may be placed within the circular portion of the tabs 22, 24 and 26. By heating the terminals 12, the solder will melt and make contact with the terminal pads 38. The solder rods 40 may have a flux core to improve the wetting of all the metal surfaces. The solder connections increase the electrical connection between the terminals 12 and the terminal pads 38 and also provides for improved mechanical connection between the terminals 12 and the electrical component 34.

The feet 30 and 32 of the terminals 12 project substantially perpendicularly from the sides of the electrical component 34. Thus, the electrical component 34 can be seated on a printed circuit board 42 with the feet 30 and 32 of the terminals 12 being seated on terminal pads 44 on the surface of the board. The feet 30 and 32 are secured to the terminal pads 44 by a suitable solder, not shown. Thus, the feet 30 and 32 of the terminals 12 not only make electrical connection between the terminals 12 and the terminal pads 44, but also support the electrical component 38 in an upright position on the board 42. The solder between the mounting feet 30 and 32 and the terminal pads 44 on the board 42 provide for improved electrical and mechanical connection between the electrical component 38 and the printed circuit board 42. The solder rods 40 may be of a solder having a higher melting temperature than the solder used to secure the mounting feet 30 and 32 to the terminal pads 40 on the printed circuit board 42. Thus, the solder connections between the tabs 22, 24 and 26 and the terminal pads 38 on the electrical component 34 will not be affected when the device is heated to solder the mounting feet 30 and 32 to the terminal pads 40.

Figure 2:
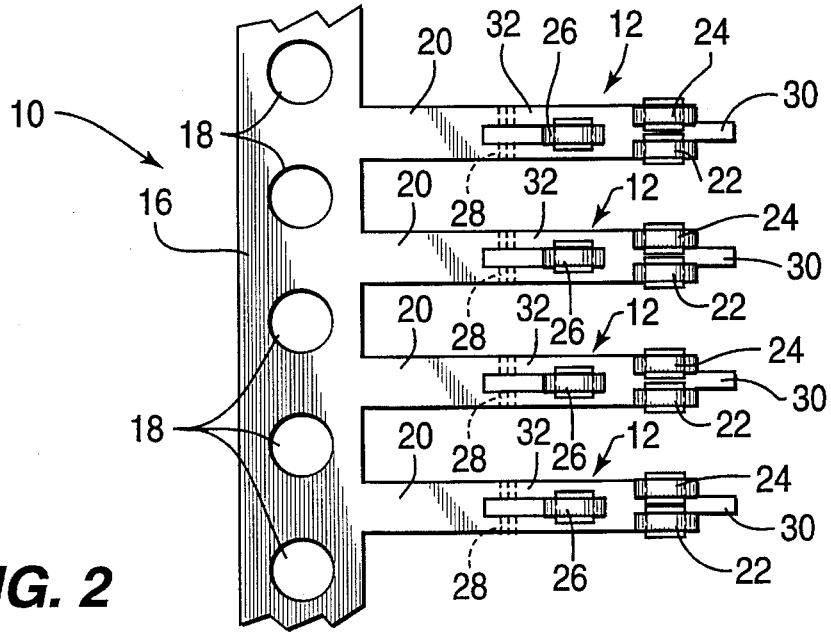
FIG. 2 is a top plan view of a carrier strip having thereon the electrical terminals of the present invention shown in FIG. 1 before being detached from the carrier strip.
Figure 3:
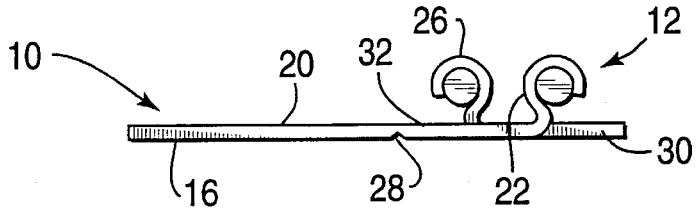
FIG. 3 is a side plan view of the carrier strip shown in FIG. 2.

Referring now to FIGS. 2 and 3, there is shown a carrier strip 10 having thereon the electrical terminals 12 of the present invention. A plurality of the individual electrical terminals 12 are connected to and extend in spaced parallel relation from a common carrier strip 16. The common carrier strip 16 is a length of flat metal with holes 18 spaced along the length thereof. Each of the terminals 12 is a flat metal strip 20 extending from the carrier strip 16 between a pair of adjacent holes 18. At the end of each of the terminal strips 20, a spaced pair of the terminal tabs 22 and 24 project from a surface of the strip 20 in the same direction. The tabs 22 and 24 are spaced from each other and are along opposite side edges of the strip 20. The free ends of the tabs 22 and 24 are bent in the form of an open circle which faces substantially toward the free end of the strip 20. The third terminal tab 26 projects from the strip 20 in the same direction as the tabs 22 and 24. The tab 26 is spaced from the tabs 22 and 24 on the side thereof away from the end of the strip. Also, the tab 26 is positioned between the tabs 22 and 24. The tab 26 has its free end bent in the form of an open circle which faces away from the tabs 22 and 24. Thus, the tab 26 forms with the tabs 22 and 24 a substantially U-shaped clip which can receive therein the electrical component 34.

A notch 28 is in and extends across the strip 20 spaced from the tab 26. The notch 28 allows for ease of breaking the terminal 12 from the strip 20. Also, the portion of the strip 20 between the free end of the strip 20 and the tabs 22 and 24 forms the first mounting foot 30 at one side of the terminal 12, and the portion of the strip 20 between the tab 26 and the notch 28 forms the second mounting foot 32 at the other side of the terminal 12. Thus, the feet 30 and 32 are in substantially the same plane and extend in opposite directions from the tabs 22, 24 and 26. The tabs 22, 24 and 26 are formed by cutting slots through the strip 20 and bending the portions of the strip 20 between the slots in a manner to form the tabs 22, 24 and 26 having the circular end portions.

The terminals 12 are mounted on the electrical component 34 while the terminals 12 are still a part of the carrier strip 10. For this purpose, the electrical component 34 is merely inserted between the tab 22, 24 and 26 of several of the terminals 12. The electrical component 34 is designed so that the terminal pads 38 are spaced apart the same distance as the spacing between the terminals 12 on the terminal strip 10. The holes 18 in the carrier strip 10 serve to properly position the terminals 12 with regard to the electrical components 34 in a machine for automatically mounting the terminals 12 on the electrical components 34. The strips 20 are then broken or cut along the notches 28 to separate the individual terminals 12 from the terminal strip 10 leaving the terminals 12 mounted on the electrical component 34. If desired, the electrical component 34 can be heated to cause the solder rods 40 to melt and flow onto the terminal pads 38. However, this can be carried out after the terminals 12 are separated from the carrier strip 10. After the terminals 12 are separated form the carrier strip 10, the electrical components 34 with the terminals 12 secured thereto can be seated in an upright position on a printed circuit board 42 with the feet 30 and 32 being on the terminal pads 44 of the board 42. When the feet 30 and 32 are soldered to the terminal pads 44, the electrical component 34 will then be surface mounted in an upright position on the printed circuit board 42 with the mounting feet 30 and 32 providing sturdy support for the electrical component 34.

Figure 4:
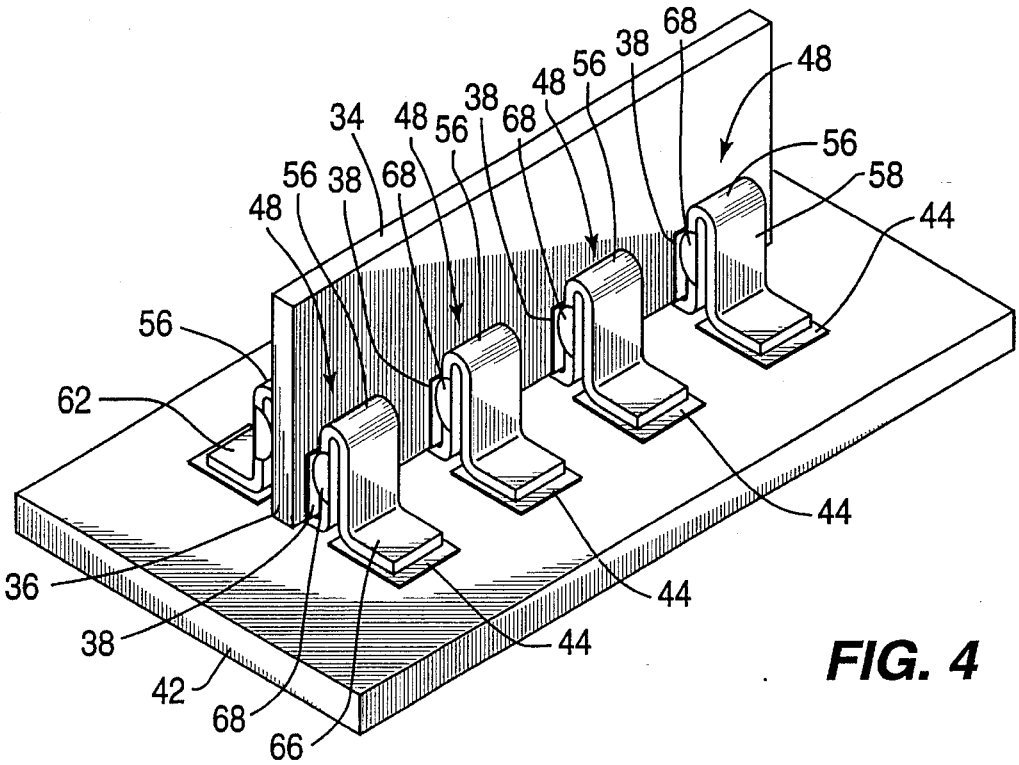
FIG. 4 is a perspective view of an electrical component having thereon another form of the electrical terminal of the present invention and surface mounted on a printed circuit board.

Referring now to FIG. 4, there is shown an electrical component 34 having another form of the terminals 48 of the present invention mounted in spaced relation along an edge 36 thereof. Each of the terminals 48 comprises a flat strip 54 of a conductive metal having a pair of spaced, parallel tabs 56 projecting in the same direction therefrom and forming a U-shaped clip therebetween. Each tab 56 is formed of a pair of parallel legs 58 connected together at their free ends. The legs 58 of the two tabs 56 which are closest to and face each other have a slot 60 extending partially thereacross from an edge thereof. As will be explained later, the slots 60 are adapted to contain solder. First and second mounting feet 62 and 66 extend in opposite directions from the outer legs 58 of the tabs 56 and are substantially in the same plane.

The edge 36 of the electrical component 34 fits between the tabs 56 of each of the terminals 48 with each of the tabs 56 contacting a terminal pad 38 on opposite sides of the electrical component 34. The thickness of the electrical component 34 is slightly greater than the distance between the tabs 56 so that the tabs 56 are flexed slightly to make good contact with the electrical component 34. If desired, solder 68 may be placed in the slots 60 in the legs 58 prior to mounting the terminals 48 on the electrical component 34. The electrical component 34 can then be heated to cause the solder 68 to flow and provide good electrical and mechanical connection between the terminal 48 and the electrical component 34. Alternatively, the terminals 48 can be mounted on the electrical component 34 first, and then the solder 68 can be heated and flowed between the tabs 56 and the electrical component 34 without the solder 68, and then the solder 68 can be applied to the joint and heated so that the solder 68 flows between the tabs 56 and the terminal pads 38 of the electrical component 34 and into the slots 60.

Figure 5:
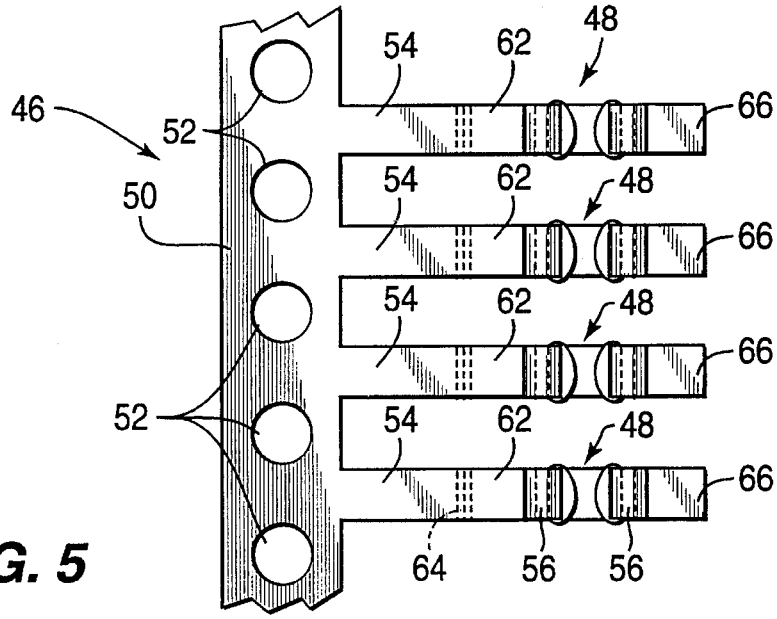
FIG. 5 is a top plan view of a carrier strip having thereon the electrical terminals shown in FIG. 4 before being detached from the carrier strip.
Figure 6:
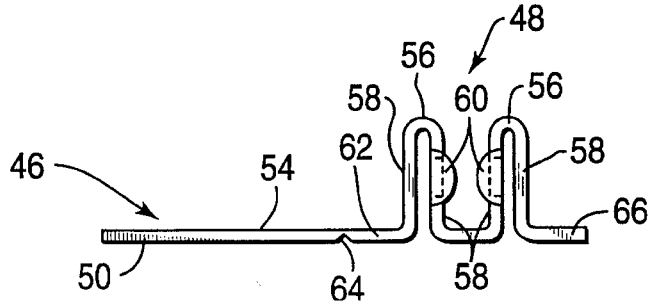
FIG. 6 is a side plan view of the carrier terminal shown in FIG. 5.

Referring now to FIGS. 5 and 6, there is shown a carrier strip 46 having the electrical terminals 48 thereon. The carrier strip 46 comprises a flat common strip 50 of a conductive metal having a plurality of spaced holes 52 therethrough. The terminals 48 are formed on flat strips 54 of the metal extending in spaced, parallel relation from the common strip 50 with each flat strip 54 being between a pair of adjacent holes 52. The terminals 48 each comprises the pair of spaced, parallel tabs 56 projecting in the same direction from the flat strip 54 and forming a U-shaped clip therebetween. Each tab 56 is formed of a pair of the parallel legs 58 connected together at their free ends. The legs 58 of the two tabs 56 which are closest to and face each other have the slots 60 therethrough. The portion of the flat strip 54 between one of the tabs 56 and the free end of the flat strip 54 forms the first foot 62. A notch 64 is in and extends across the flat strip 54 spaced from the tab 56 furtherest from the free end of the flat strip 54. The portion of the flat strip 54 between the notch 64 and the adjacent tab 56 forms the second foot 66. The feet 62 and 64 are substantially in the same plane and extend in opposite directions from the tabs 56.

The electrical component 34 is secured to the terminals 48 while they are still a part of the terminals strip 46. For this purpose, the terminals pads 38 are spaced apart a distance equal to the spacing between the terminals 48 on the terminal strip 46. The edge 36 of the electrical component 34 is inserted between the spaced tabs 56 of the terminals 48 so that each terminal pad 38 is between a pair of tabs 56 and contacts one of the legs 58 of one of the tabs 56. If desired, the solder 68 can be applied to the terminals 48 so as to electrically and mechanically bond the terminals 48 to the electrical component 34. The flat strips 54 are then broken or cut along the notches 64 to separate the terminals 48 from the terminal strip 46.

The electrical component 34 with the terminals 48 attached thereto can then be seated on a printed circuit board 42 with the feet 62 and 66 being seated on the printed circuit board 42 and contacting terminal pads 44 on the printed circuit board 42. The feet 62 and 66 can then be soldered to the terminal pads 44 to secure the terminals 48 electrically and mechanically to the printed circuit board 42 with the electrical component 34 being rigidly supported in an upright position on the printed circuit board 42.

Thus there is provided by the present invention terminals for an electrical component which have tabs forming a U-shaped element into which the edge of the electrical component is inserted. The terminals also have feet projecting from the tabs so as to support the electrical component in an upright position on the surface of a printed circuit board. The tabs can be soldered to the electrical component and the feet can be soldered to the printed circuit board so that the electrical component is electrically and mechanically secured to the printed circuit board. The feet of the terminals hold the electrical component in a firm position so that the electrical component cannot be easily bent from it upright position on the printed circuit board. The terminals can be formed as a terminal strip having a plurality of the terminals thereon. This allows the electrical component to be attached to a plurality of the terminals easily and quickly while the terminals are a part of the terminal strip. The terminal strip can be broken or cut to separate the electrical terminals from the terminal strip while the terminals are attached to the electrical component.

What is claimed is:

1. An electrical component comprising:

a body having an edge;

at least one electrical terminal secured to said body at said edge;

said terminal comprising a metal strip having a plurality of spaced tabs extending in the same direction from the strip and forming a U-shaped clip therebetween with said edge of the body fitting within the U-shaped clip between the tabs, and a pair of feet extending in substantially the same plane in opposite direction from the tabs and adapted to support the electrical component on the surface of a printed circuit board.

2. The electrical component of claim 1 in which the body is of a thickness greater than the spacing between the tabs so that the tabs tightly engage the body.

3. The electrical component of claim 2 in which the body has a terminal pad adjacent said edge and at least one tab of the terminal engages the terminal ad to electrically secure the terminal to the electrical component.

4. The electrical component of claim 3 further comprising a solder between the one tab and the terminal pad to electrically and mechanically secure the terminal to the electrical component.

5. The electrical component of claim 1 wherein there are three tabs extending from the metal strip with two of the tabs being in aligned relation and positioned on one side of the body and the third tab being spaced from the two tabs and positioned on an opposite side of the body so that the tabs grip the body therebetween.

6. The electrical component of claim 5 in which each of the tabs has a circular portion at its end.

7. The electrical component of claim 6 in which the circular portion of the tabs extend away from the respective side of the body.

8. The electrical component of claim 7 including a plurality of said electrical terminals mounted in spaced relation along said edge of the body.

9. The electrical component of claim 8 wherein the body has a plurality of terminal pads spaced along said edge of the body with a tab of each of the terminals contacting a separate one of the terminal pads.

10. The electrical component of claim 9 wherein a solder is between each of the terminals and its respective terminal pad to electrically and mechanically connect the terminals to the body.

11. The electrical component of claim 1 in which each of the tabs comprises a pair of parallel legs connected together at their free ends with one leg of each of the tabs facing each other and the body fits between and is engaged by the legs of the tabs which face each other.

12. The electrical component of claim 11 in which each foot extends from a leg of a separate one of the tabs.

13. The electrical component of claim 12 in which the feet extend from the legs of the tabs which do not engage the body.

14. The electrical component of claim 13 including a plurality of said electrical terminals mounted in spaced relation along said edge of the body.

15. The electrical component of claim 14 wherein the body has a plurality of terminal pads spaced along said edge of the body with a tab of each of the terminals contacting a separate one of the terminal pads.

16. The electrical component of claim 15 wherein a solder is between each of the terminals and its respective terminal pad to electrically and mechanically connect the terminal to the body.

17. An electrical terminal comprising:

a metal strip having a plurality of spaced tabs extending in the same direction from the strip and forming a U-shaped clip therebetween which is adapted to receive an electrical component therebetween; and a pair of feet extending in substantially the same plane in opposite directions from the tabs to support the terminal on the surface of a printed circuit board.

18. The electrical terminal of claim 17 wherein there are three tabs extending from the metal strip with two of the tabs being in aligned relationship and the third tab being spaced from the two tabs to form the U-shaped clip therebetween.

19. The electrical terminal of claim 18 in which each of the tabs has a circular portion at its end.

20. The electrical terminal of claim 19 in which the circular portion of the two tabs extend away from the third tab, and the circular portion of the third tab extends away from the two tabs.

21. The electrical terminal of claim 17 in which each of the tabs comprises a pair of parallel legs connected together at their free ends with one leg of each of the tabs facing each other to form the U-shaped clip of the terminal.

22. The electrical terminal of claim 21 in which each foot extends from a leg of a separate tab.

23. The electrical terminal of claim 22 in which the feet extend from the legs of the tabs which do not face each other.

24. The electrical terminal of claim 22 in which each of the legs of the tabs which face each other has an opening therethrough.

25. A carrier strip comprising:

a flat metal carrier strip;

a plurality of metal terminal strips spaced along and extending in the same direction from the carrier strip;

a plurality of spaced tabs extending in the same direction from each of the terminal strips and forming a U-shaped clip therebetween;

a foot portion extending from one of the tabs on each terminal strip to the free end of the terminal strip; and a notch extending across each terminal strip spaced from another tab to form another foot portion between the notch and the other tab.

26. The carrier strip of claim 25 wherein there are three tabs extending from each terminal strip with two of the tabs being in aligned relationship and the third tab being spaced from the two tabs to form the U-shaped clip therebetween.

27. The carrier strip of claim 25 in which each of the tabs has a circular portion at its end.

28. The carrier strip of claim 27 in which the circular portion of the two tabs extend away from the third tab, and the circular portion of the third tab extends away from the two tabs.

29. The carrier strip of claim 25 in which each of the tabs comprises a pair of parallel legs connected together at the free ends with one leg of each of the tabs facing each other to form the U-shaped clip therebetween.

30. The carrier strip of 29 in which each foot extends from a leg of a respective tab.

31. The carrier strip of claim 30 in which the feet extend from the legs of the tabs which do not face each other.

32. The carrier strip of claim 30 in which each of the legs of the tabs which face each other have an opening therethrough.

* * * * *